United States Patent [19]

Pharr

[11] Patent Number: 4,526,209

[45] Date of Patent: Jul. 2, 1985

[54] CARPET LOOM

[75] Inventor: Roy E. Pharr, Stoneville, N.C.

[73] Assignee: Fieldcrest Mills, Inc., Eden, N.C.

[21] Appl. No.: 569,846

[22] Filed: Jan. 11, 1984

[51] Int. Cl.[3] ..... D03D 39/20

[52] U.S. Cl. ..... 139/46

[58] Field of Search ..... 139/46, 47, 48

[56] References Cited

U.S. PATENT DOCUMENTS

| | | | |
|---|---|---|---|
| 790,028 | 6/1904 | Buckler | 139/46 |
| 2,868,231 | 1/1959 | Robb | 139/46 |
| 3,092,149 | 6/1963 | Robb | 139/46 |
| 3,199,542 | 8/1965 | Erkes | 139/46 |

FOREIGN PATENT DOCUMENTS 205130 4/1923 United Kingdom .

*Primary Examiner*—Henry S. Jaudon
*Assistant Examiner*—Steven Shongut
*Attorney, Agent, or Firm*—Bell, Seltzer, Park and Gibson

[57] ABSTRACT

The carpet loom has pile wires extending warpwise with associated pile yarn transfer hooks for positioning preselected pile yarns over the pile wires for forming pile loops. The pile wires are pivotally mounted so as to be restingly positioned on the base fabric being woven to assure obtaining the desired pile height loop and to avoid undue tensions and stresses in the fabric being woven to assure smooth efficient loom operation. The transfer hooks extend rearwardly with their hook portions positioned substantially in a horizontal plane and inclined downwardly at an acute angle from the horizontal plane. This positional arrangement of the transfer hooks and the associated mechanism for imparting a reciprocatory movement to the transfer hooks permits an uninterrupted reciprocation of the reed to take place as well as the changing of the pile yarn and ground warp shed. This results in a high speed of loom operation of about twice the rate of prior carpet looms.

5 Claims, 12 Drawing Figures

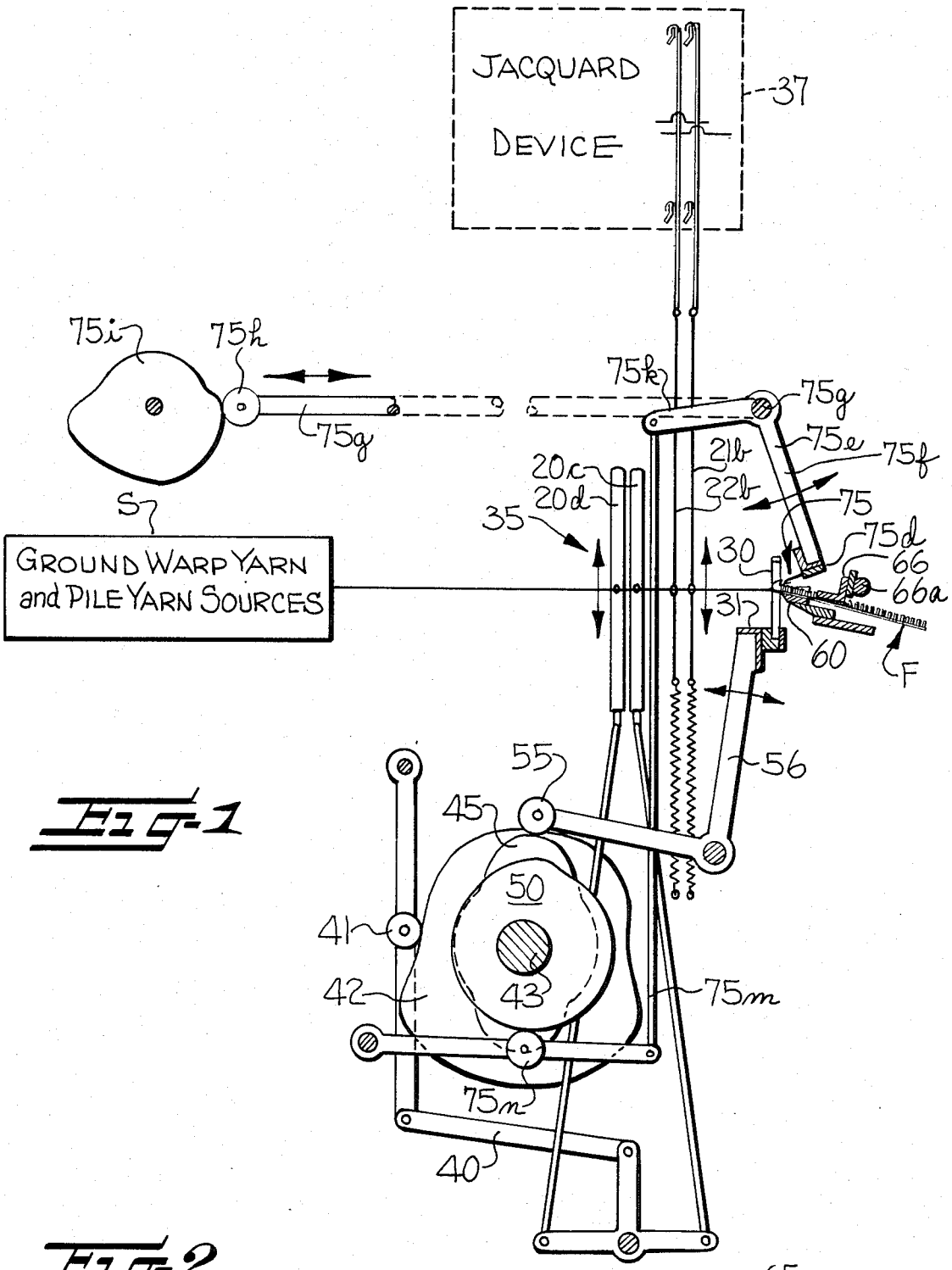
Fig-1
Fig-2
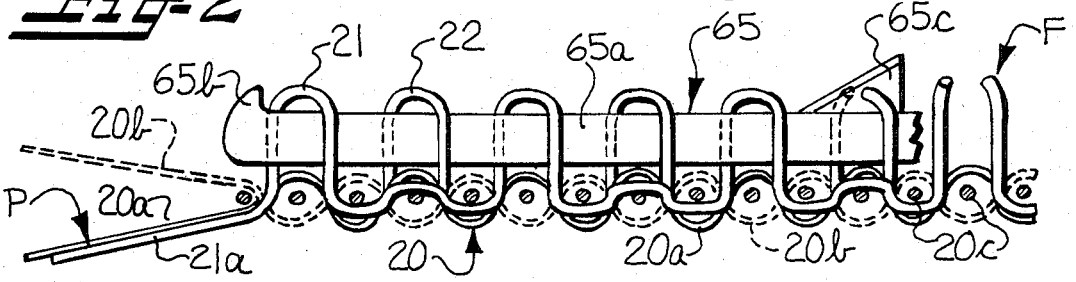

(0° OR 360°) A (47°) B (47°)

(60°)

(180°) C (205°) D

CARPET LOOM

This invention relates to looms for making pile fabrics and more particularly to a loom for making pile carpets. The loom of this invention is of the type having pile wires positioned to extend warpwise and over which pile yarns are moved by transfer hooks for obtaining the desired pile loops. Looms of this general type are known, such as disclosed in British Pat. No. 205,130 (1923).

It has been determined that the instant loom has a considerably higher rate of production than other known carpet looms. For example the state of the art for jacquard gripper Axminster looms is 45 pile insertions per minute while about 50 pile insertions per minute is the rate for Wilton looms. From tests made on the instant loom and experience gathered to date, it appears that the production rate of this loom is about twice that of these prior art carpet looms.

In the development of this invention it was recognized that the pile wires should rest against the backing fabric in order to obtain a uniform height pile loop extending above the backing fabric. To this end, the pile wires were adjusted to rest against the backing fabric and then fixedly secured in this position. However it was soon learned that it was extremely difficult to properly position the pile wires so as to be restingly received on the backing fabric. Very often the pile wires were positioned out of engagement with the backing fabric which resulted in several problems during the weaving operation. Of utmost concern was the fact that the pile loops were not uniformly formed over the pile wires because the movement of the pile yarns over the pile wires caused the backing fabric to be pulled in from opposite sides due to the excessive tension on the pile yarns when being positioned over the pile wires. It was further learned that the frictional resistance of the pile loops over the pile wires and by the backing fabric being pulled up against the bottom edge of the pile wires resulted in such an amount of torque being created that the take-up roll could not properly function to take up the fabric as the weft insertions were being placed therein.

To overcome these problems and to obtain the desired high speed of loom operation as originally sought, it was determined that the mounting of the pile wires for unitary free pivotal movement would substantially eliminate the variance in height of pile loops being formed and at the same time eliminate the undue friction and drag of the pile yarns and backing fabric on the pile wires. With the pile wires being mounted for pivotal movement the positioning of the pile yarns over the pile wires by the action of the transfer hooks caused the pile wires to be moved down into contacting engagement with the ground fabric and to properly ride and rest on the ground fabric throughout the weaving operation.

This invention is further characterized in that the pile yarn transfer hooks are mounted for reciprocatory forward and rearward movement and are positioned substantially in a horizontal plane with the hook portions of the transfer hooks being directed rearwardly and transversely inclined at an acute angle downwardly from the horizontal plane. This positional arrangement of the transfer hooks assures engagement of the pattern controlled preselected pile yarns by the hooks and additionally enables the hooks to readily be disengaged from the pile yarns by an arcuate rear reciprocatory movement and lateral shogging of the hooks during uninterrupted reciprocation of the reed and during changing of the pile yarn shed.

BRIEF DESCRIPTION OF THE DRAWINGS

Some of the features of this invention having been stated, others will appear as the description proceeds when taken in connection with the accompanying drawings, in which—

FIG. 1 is a schematic longitudinal vertical sectional view of a loom embodying the present invention;

FIG. 2 is a warpwise fragmentary view through a portion of a pile fabric as woven in accordance with the invention, and schematically illustrating a portion of a warpwise pile wire in association therewith;

DETAILED DESCRIPTION

Figure 3:
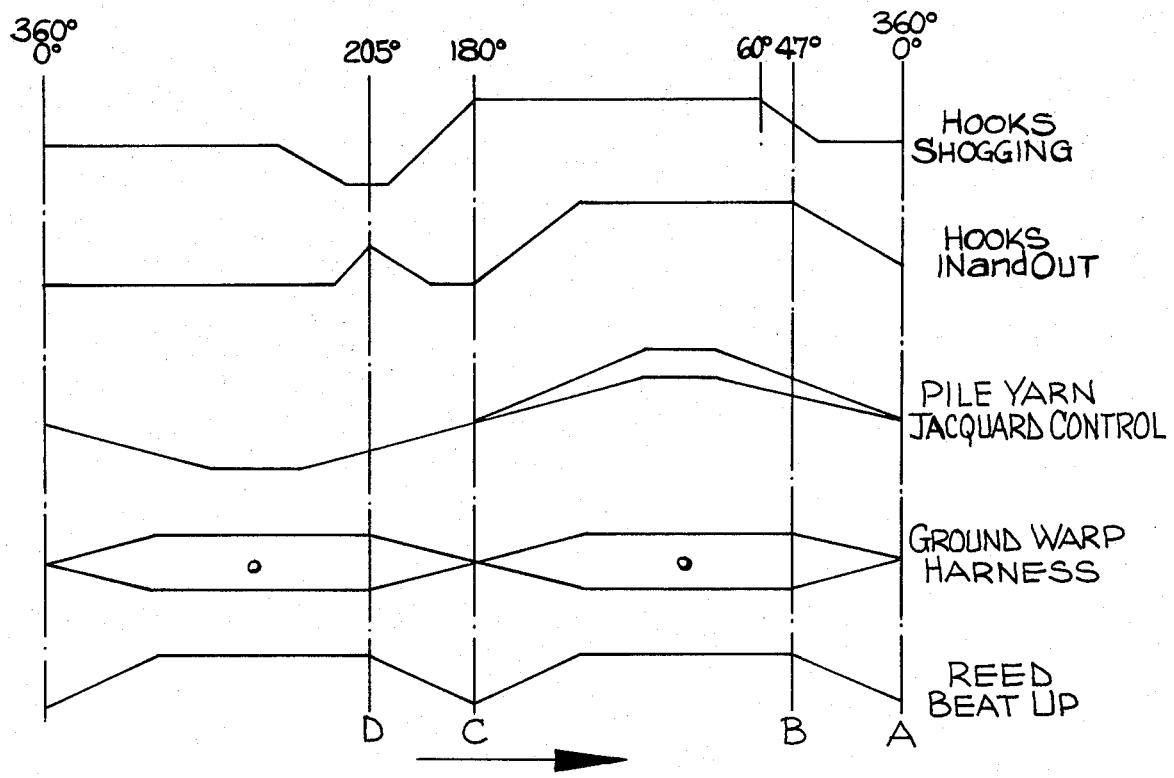
FIG. 3 is a diagrammatic illustration of the sequence of operations of essential components of the loom, in a single, two-shot, pile forming cycle thereof.

While this invention will be described hereinafter with particular reference to the accompanying drawings, in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

The weaving machine or loom illustrated in the drawings embodies apparatus for weaving a two-shot pile fabric. Typically, a two-shot pile fabric is characterized by having a weftwise extending row of pile loops or U-shaped cut pile tufts formed with every two picks or beats of the loom, i.e., there are two single strand or multiple strand weft shots or picks of weft yarn to every weftwise row of pile. It is to be noted, however, that the loom may be modified to produce pile fabrics having three or more weft shots for each weftwise row of pile being woven, without departing from the invention.

Referring to the drawings more in detail the exemplary fabric F shown in FIG. 2 comprises a backing 20 of base or ground warp yarns 20*a*, 20*b* interwoven with weft yarns 20*c*. Weftwise and warpwise rows of pile are formed of pile yarns selected from a group of pile yarns P. By way of illustration, the pile fabric F has pile loops 21 formed from one type (kind or color) of pile yarn 21*a* selected from the pile yarn group P, and the pile fabric F has other pile loops 22, which are shown arranged in alternation with the loops 21 in the warpwise direction, the pile loops 22 being formed from another type (kind or color) of pile yarn 22*a* selected from the pile yarn group P. In this particular embodiment of the fabric F, following the formation of the pile loops 21, 22, all of them are cut on the loom to form generally U-shaped cut pile tufts therefrom as shown in the right-hand portion of FIG. 2. Having thus described the fabric F, the following description of the loom embodying the invention, and the operation of the loom, may be clearly understood by references to the illustration of the fabric F.

Referring now to FIGS. 1, 4, 5, 8 and 9, the loom there shown comprises the usual weaving instrumentalities including a weft beating means, such as an oscillatable reed 30 and lay 31, a suitable weft inserting means 32 (FIG. 5) and shed forming means generally designated at 35. The shed forming means 35 serves for shedding the base or ground warp yarns 20*a*, 20*b*, in forming the backing 20 (FIG. 2) of the pile fabric, and for shedding the pile yarns P. To this end, the ground warp yarns 20*a*, 20*b* extend from a suitable source S forwardly through respective sets of harnesses or heddles 20*c*, 20*d*, and the pile yarns P also extend from source S through heddles. In this instance, since there are two different types (kinds and/or colors) of pile yarns P used in making the fabric F, it may be assumed that pile yarns 21*a* of one type extend through heddles 21*b* and that pile yarns 22*a* of the other type extend through heddles 22*b*. Since the shedding of the pile yarn heddles 21*a*, 22*a* is controlled by a jacquard device 37, and the operation of each heddle 21*a*, 22*a* is individually selectively controlled, it can thus be appreciated that it may be the designer's choice as to that one of the pile yarns which is to extend through a particular one of the pile yarn heddles.

Since jacquard devices are well known to those familiar with the weaving arts, a further more detailed description thereof is deemed unnecessary. The jacquard device serves as pattern means operatively associated with the shed forming means 35 for forming the desired pile fabric pattern.

The ground warp heddles 20*c*, 20*d* are raised and lowered in opposition to each other during each pile forming cycle of the loom by suitable mechanical connections 40 (FIG. 1) including a follower 41 engaging a rotary cam 42. The cam 42 is suitably secured on a driven cam shaft 43 on which a reed operating cam 45 and a transfer hook-reciprocating cam 50 are also suitably secured. The cam 45 is engaged by a follower 55 which, by suitable mechanical connections 56 (FIG. 1), is mechanically connected to lay 31 and reed 30 for oscillating the same forwardly and rearwardly in timed relation to the operation of the heddles 20*c*, 20*d*, 21*b*, 22*b* and the weft inserting means.

During each forward or beat-up stroke of the reed 30, it moves into close proximity to a stationary nose board or breast beam 60 whose rear edge substantially coincides with the beat-up point of the reed 30 and with the fell of the fabric F being woven. The nose board 60 extends weftwise of and is suitably secured to the frame, not shown, of the loom, as is usual. During weaving, the backing 20 of the fabric F slides forwardly over and against the upper surface of nose board 60 and, preferably, the fabric take-up roll or other suitable take-up means, not shown, is positioned so as to bias the fabric F downwardly against the nose board 60 while taking up the fabric at the desired rate in relation to the rate of oscillation of reed 30.

In order to form warpwise rows of pile from the pile yarns P on the backing 20 of the fabric F, the loom is equipped with a weftwise row or group of warpwise extending pile formers or pile wires 65 (see FIGS. 2 and 4–12) whose body portions 65*a* are largely positioned forwardly of the beat-up point of the reed 30 and overlie and rest upon that portion of the fabric backing 20 beneath which the nose board 60 is positioned. Preferably, there is one of the warpwise pile wires 65 provided for each of the dents or spaces between the splits 30*a* (FIGS. 6, 7 and 10–12) of reed 30, and each of the pile wires 65 has an upstanding rear portion shoulder or projection 65*b* thereon which extends rearwardly into the respective dent of reed 30 each time the reed occupies a full beat-up position.

Each pile wire 65 also has a cutting blade or knife 65*c* thereon spaced forwardly of the upwardly projecting rear portion 65*b* of the respective pile wire 65, and the cutting edge of each knife 65*c* is inclined upwardly and forwardly at an angle from the upper surface of the body portion 65*a* of the respective pile wire 65 so as to sever or cut each successive pile loop as it is advanced along the body portion 65*a* of the respective pile wire following the formation of the pile loops over the corresponding pile wire.

As the successive pile loops are formed over the pile wires 65, in a manner to be later described, they are pulled downwardly against the pile wires so as to obtain the desired height of pile loops. Heretofore, difficulties have been experienced in the formation of pile loops and in taking up the pile fabric on a loom equipped with pile wires of the general type described above. Owing to the friction between the pile wires and the loop pile fabric, it was found that the movement of pile loops along the pile wires into engagement with the knives was severely impeded, even to such an extent as to deflect the pile wires toward one another in the warpwise direction and to fracture or misalign parts of the fabric take-up mechanism of the loom. It was discovered that this problem was caused due to the fact that the pile wires were mounted in fixed positions closely adjacent to and relative to the nose board of the loom. Accordingly, to permit unimpeded movement of the pile loops along the pile wires into engagement with the knives, means are provided mounting the group of pile wires 65 for pivotal movement about an axis extending weftwise of the loom and forwardly of the upstanding rear portions of the pile wires so that the pile wires may be pivotally moved downwardly by the tension in the pile yarns looped thereover for moving the pile wires into engagement with and to rest upon the base fabric being woven. To this end, it will be observed in FIGS. 4, 5 and 6 that the front ends of the pile wire body portions 65*a* are suitably secured to an elongate, weftwise extending frame member or support bar 66 carried by a pivot shaft 66*a* extending substantially parallel with the bar 66 and whose opposite ends are pivotally supported on the loom frame, as by suitable bearings, not shown. Such bearings may be suitably secured to any fixed part of the loom, such as the usual loom side frame members, not shown.

It can thus be seen that the pile wires 65 are permitted to rest upon the fabric F by gravity and are thus free to conform generally to the fabric surface under the force applied thereto by the pile loops formed over the respective pile wires.

As heretofore indicated, the ground warp heddles 20*c*, 20*d* are controlled by the cam 42 (FIG. 1) for shedding the base or ground warp yarns in forming the backing 20 of the pile fabric F. In this regard, the ground warp yarns 20*a*, 20*b* are shown in the intermediate or closed shed position in FIGS. 1, 4 and 8, and they are shown in substantially the fully open shed position in FIGS. 5 and 9. The ground warp yarns 20*a* may be arranged in alternation with the ground warp yarns 20*b*, and since the ground warp yarns 20*a* are raised and lowered in opposition to the raising and lowering of the ground warp yarns 20*b*, it follows that, whenever the ground warp yarns 20*a* occupy the normal upper shed position, the ground warp yarns 20*b* occupy the lower shed position and vice versa. For descriptive purposes, it may be assumed that there is one of each of the pile yarns 21*a*, 22*a* arranged between each adjacent pair of the ground warp yarns 20*a*, 20*b*, and that there is one of each of the pile yarns 21*a*, 22*a* corresponding to each pile wire 65.

Figure 4:
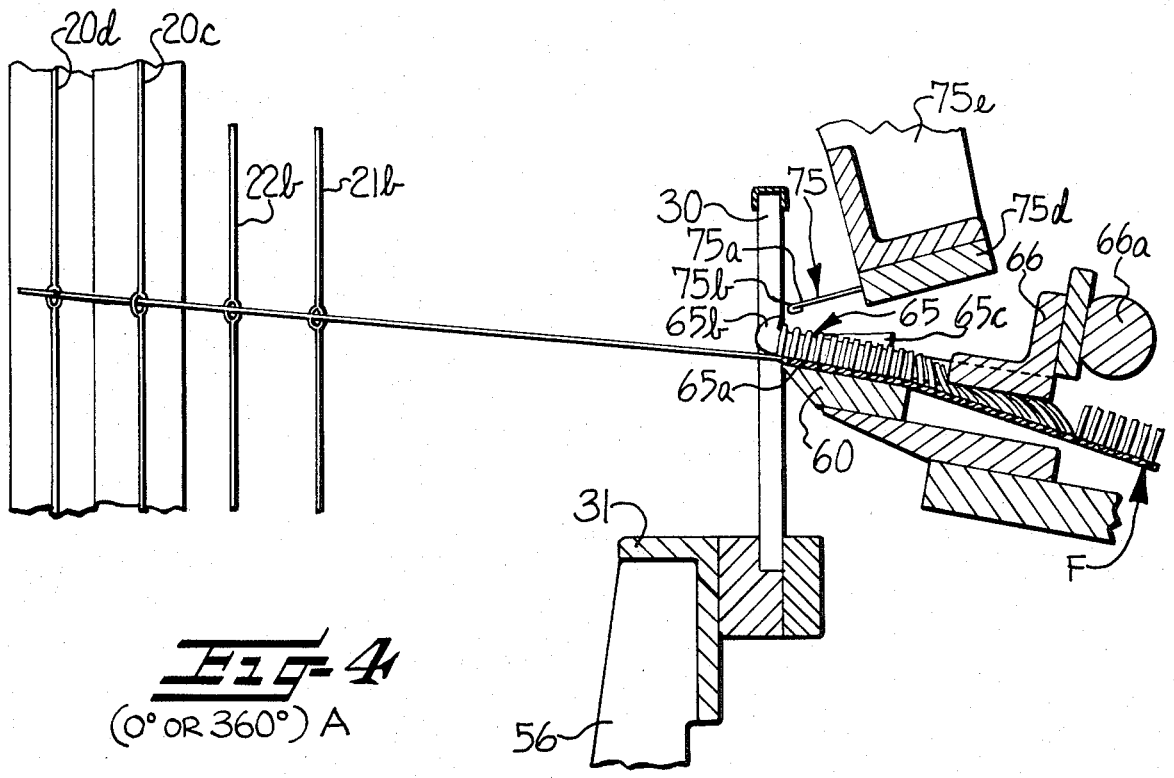
FIG. 4 is a fragmentary vertical sectional view showing the weaving and pile forming components in the right-hand central portion of FIG. 1 on an enlarged scale, and wherein the weaving and pile forming components occupy relative positions indicated by the 0°–360° position "A" of the pile forming cycle graphically illustrated in FIG. 3.

Improved means are provided for positioning selected pile yarns P over the respective pile wires 65 for forming pile loops therefrom, such means comprising a group of pile yarn transfer hooks, broadly designated at 75, arranged in a weftwise row and normally occupying an inactive or forward position above the body portions 65*a* of the pile wires 65, as shown in FIG. 4.

Figure 5:
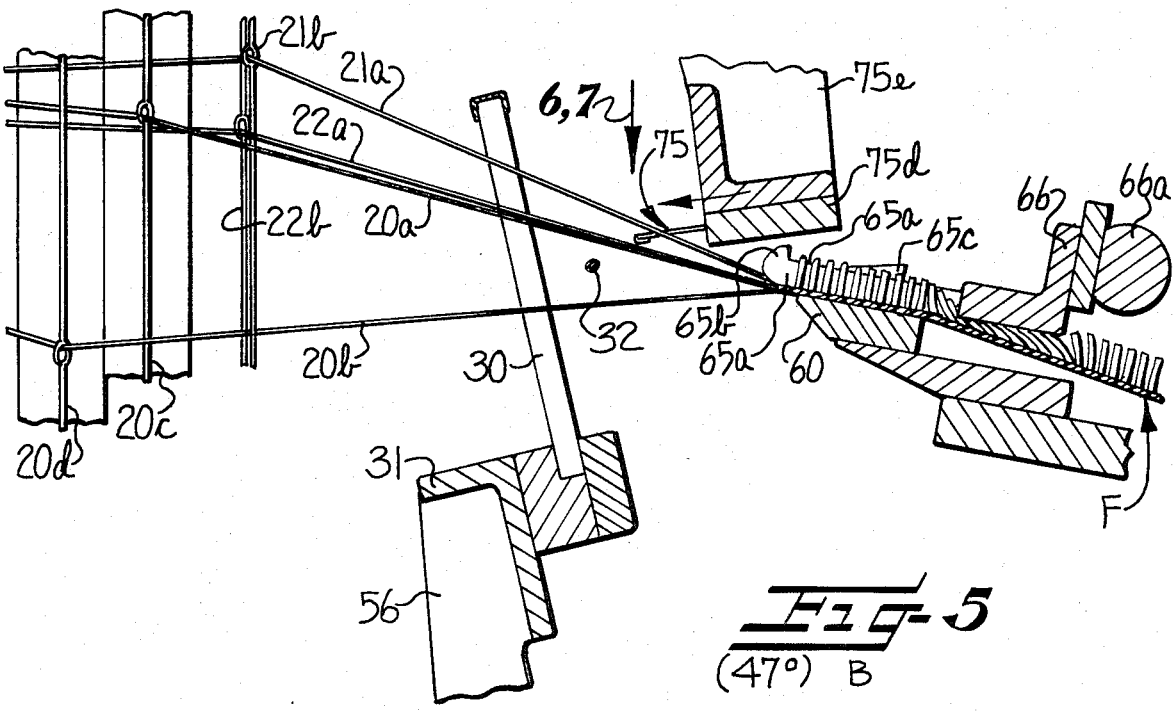
FIG. 5 is a view similar to FIG. 4, but showing the weaving and pile forming components occupying relative positions indicated by the 47° position "B" of the pile forming cycle graphically illustrated in FIG. 3.
Figure 6:
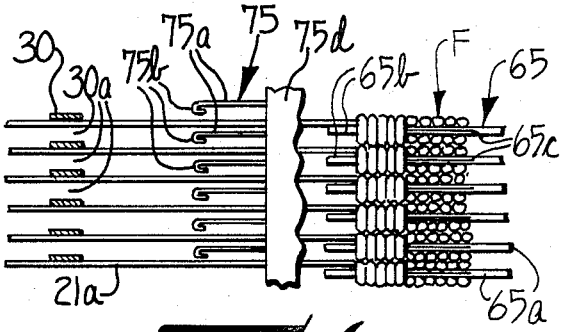
FIGS. 6 and 7 are fragmentary plan views looking in the direction of the arrow 6, 7 of FIG. 5, but wherein the pile yarn transfer hooks occupy different respective positions indicated by the 47° position "B" and the 60° position graphically illustrated in FIG. 3.
Figure 7:
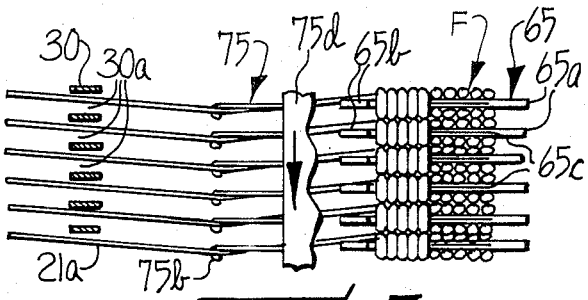

Before describing the transfer hooks 75 more in detail, it should be noted that the pile yarns P are raised and lowered under control of the jacquard device 37, during the shed forming operation in unison with one of the sets of ground warp yarns; the ground warp yarns 20*a* in this instance. Thus, since the ground warp yarns 20*a* only occupy the raised or upper shed position during alternate picks of the loom, it follows that all of the pile yarns P occupy the upper shed position, in substantially the same plane as the ground warp upper shed position, substantially as the set of ground warp yarns 20*a* occupy the upper shed position. However, the jacquard device 37 further elevates or raises selected heddles 21*b* and/or 22*b* to thereby raise the selected pile yarns, relative to the ground warp yarns 20*a* and the non-selected pile yarns, so that the selected pile yarns are positioned at a higher upper shed position than the non-selected pile yarns for facilitating engagement of the transfer hooks 75 with the selected pile yarns, substantially as shown in FIGS. 5 and 7.

Referring again to the transfer hooks 75, it will be observed in FIGS. 4, 5, 8 and 9 that each transfer hook 75 comprises a generally warpwise extending, elongate body or shank 75*a* having a substantially U-shaped hook portion 75*b* on the rear end thereof. The transfer hooks 75 are mounted for reciprocatory, warpwise, forward and rearward movement, in a nearly horizontal arcuate path adjacent the pile wires 65, there being one of the transfer hooks 75 provided for each pile wire 65, and means are provided for imparting reciprocatory substantially warpwise movement to the group of transfer hooks for effecting engagement of the same with the selected pile yarns and for moving the selected pile yarns over and across the pile wires and into engagement with the upstanding rear portions 65*b* of the pile wires 65.

Accordingly, it will be observed in FIGS. 4 through 12 that the front portions of the shanks 75*a* of the transfer hooks 75 are embedded in or otherwise suitably secured to a weftwise extending frame member or bar 75*d* fixedly mounted to the lower ends of suitable swing arms 75*e*, only one of which is shown in FIG. 1. The swing arm 75*e* there shown is illustrated in the form of an arm of a bell crank 75*f* preferably journaled on, but being axially movable with, a longitudinally movable or shoggable rocker shaft 75*g*. Shaft 75*g* extends weftwise and may be suitably supported on the upper portion of the loom frame for being shogged to and fro weftwise of the loom, longitudinally of its own axis.

The means for shogging shaft 75*g*, and thereby also shogging the transfer hooks 75 weftwise of the loom, may take various forms. As illustrated schematically in FIG. 1, the rocker shaft 75*g* may be provided with a suitable follower means 75*h* on one or both ends thereof for engaging a shogging cam 75*i* being suitably driven by the loom to impart the desired reciprocatory shogging motion to the transfer hooks 75. The follower means 75*h* and cam 75*i* are shown 90° out of position in FIG. 1 for the purpose of clarity. In order to transmit the desired forward and rearward movement or warpwise shogging movement to the transfer hooks 75 in timed relation to the operation of the reed 30 and other weaving instrumentalities of the loom, an arm 75*k* of bell crank 75*f* is connected, as by suitable mechanical connections 75*m*, to a follower 75*n* which engages the cam 50 heretofore described.

It is thus seen that means are provided for moving the transfer hooks 75 forwardly and rearwardly in a path slightly inclined rearwardly and downwardly and in timed relation to weftwise shogging movements of the tranfer hooks 75. It should be noted that the transfer hooks move inwardly or rearwardly to engage and ensnare in the hook portions 75*b* thereof only those pile yarns which have been selected by the jacquard device 37 and which thus occupy the higher open shed position relative to the non-selected pile yarns in the upper sheet of ground warp yarns 20*a*.

In this instance, during portions of each alternate two shot or two pick pile loop forming cycle of the loom, the pile yarns of one set, e.g., pile yarns 21*a*, are selected and raised to the higher of the upper open shed positions (FIG. 5) by the pattern means or jacquard device 37, while the pile yarns 22*a* of the other set are not selected and therefore occupy the normal or lower of the upper shed positions then occupied by the ground warp yarns 20*a*. Conversely, during portions of each intervening two shot pile loop forming cycle of the loom, the pile yarns 22*a* of the last-mentioned other set are selected and raised to the higher of the upper open shed positions by the jacquard device 37, while the pile yarns 21*a* in the one set occupy the normal upper open shed position then as substantially occupied by the ground warp yarns 20*a*.

In either event, in order that the selected pile yarns are properly engaged by the transfer hooks 75, the hook portions 75*b* must move rearwardly between respective adjacent pairs of the selected pile yarns and into the upper shed space defined between the two sets of selected and non-selected pile yarns. In order to facilitate the passage of the hook portions 75*b* of the transfer hooks 75 through the sheet of selected pile yarns, and to aid in doffing a previously engaged pile yarn from each respective hook portion 75*b*, each hook portion 75*b* is transversely inclined at an acute angle downwardly from the horizontal and in a direction toward the nib of the respective hook portion 75*b*. All the nibs of the hook portions 75*b* face generally in the same weftwise direction with respect to the shanks 75*a* of the transfer hooks and such that the hook portions will properly engage the selected pile yarns during subsequent forward motion of the transfer hooks as will be later described more in detail.

METHOD OF OPERATION

Figure 12:
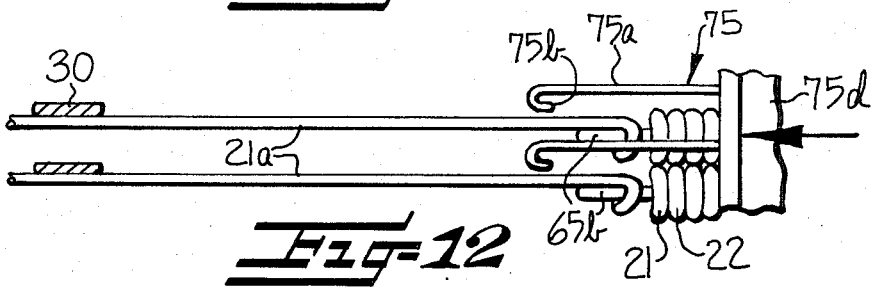

At the start of a pile forming cycle of the loom, it may be assumed that pile loops are to be formed from pile yarns 21*a* as the pile yarns 22*a* are being woven into the base of the fabric without forming loops from the pile yarns 22*a*. It is to be assumed further that the reed 30 is occupying the full beat-up position of FIG. 4, with the pile yarns P and ground warp yarns 20*a*, 20*b* in the closed shed or mid shed position, and with the pile yarn transfer hooks 75 occupying a position to one side of, and above, each respective pile wire 65 substantially as shown in FIGS. 1, 4 and 12. It also may be assumed that a pile loop 22 (FIG. 2) has just been formed from each pile yarn 22*a* with the transfer hooks 75 having just released therefrom respective loops 22 of the previously selected pile yarns 22*a* and so that all the pile yarns P and the sheet of ground warp yarns 20*a* extend beneath that weft yarn 20*c* being beaten up by the reed 30 in its beat-up position of FIG. 4. At this instant in the start of the pile loop forming cycle, the sheet of ground warp yarns 20*b* extends over the latter weft yarn, as is apparent in FIGS. 2 and 4.

Following the latter beat up motion of the reed 30, the reed moves rearwardly away from the fell as the shed change then in progress is completed as shown in FIG. 5. It can be seen in FIG. 5 that the ground warp yarns 20*a*, 20*b* have thus moved to their respective upper and lower open shed positions, and all the pile yarns P are raised to their normal upper open shed position. Thereupon, the pattern means or jacquard device 37 raises the selected heddles 21*b* and the thus selected pile yarns 21*a* to the higher than normal position in which the selected pile yarns 21*a* diverge upwardly and rearwardly from the fell relative to the non-selected pile yarns 22*a*.

The pile yarn transfer hooks 75 are also moved rearwardly by the rotary cam 50 as the reed 30 moves rearwardly. In so doing, the hook portions 75*b* of the transfer hooks 75 enter the pile yarn shed by moving downwardly and rearwardly at a shallow angle to pass between the adjacent selected pile yarns 21*a* while also moving rearwardly beyond the rear upstanding free end portions 65*b* of the pile wires 65. At about the same time that the latter movement of the transfer hooks 75 is being effected, the weft inserting means inserts a weft shot 20*c* through the warp shed and beneath all the pile yarns P. The cam 75*i* then shogs the transfer hooks 75 in one weftwise direction, from about the position of FIG. 6 to that of FIG. 7, such as to move the shanks 75*a* of the transfer hooks 75 weftwise against the respective selected pile yarns 21*a*, and to thereby align the open bights of the hook portions 75*b* substantially warpwise of the respective selected pile yarns 21*a*.

Figure 8:
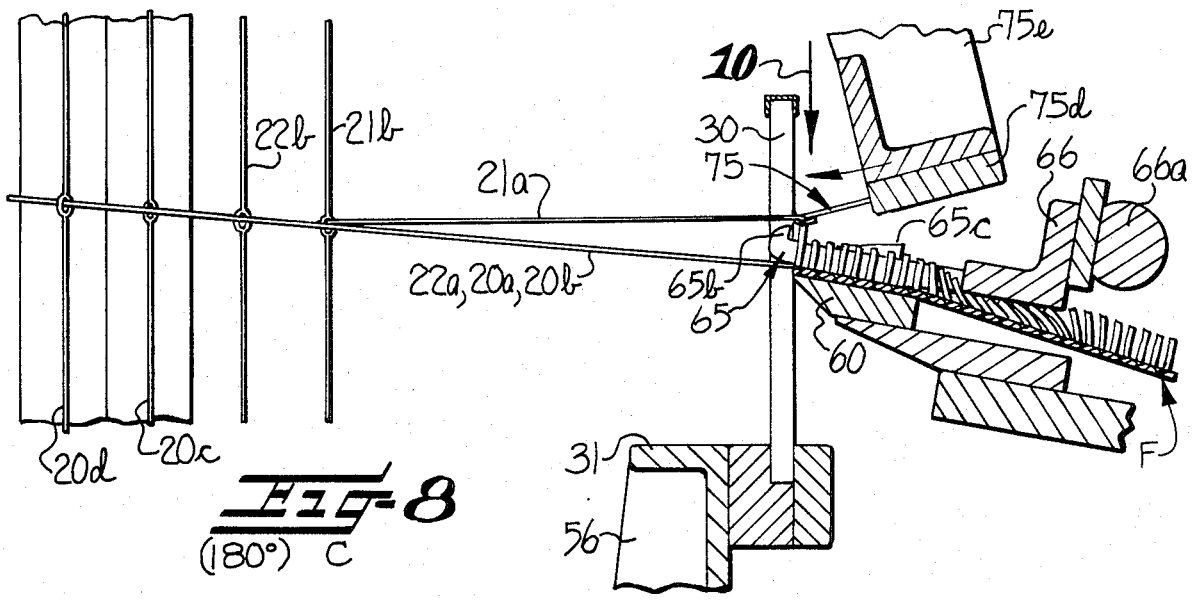
FIGS. 8 and 9 are views similar to FIGS. 4 and 5, but showing the weaving and pile forming components occupying the respective relative positions indicated by the 180° position "C" and by the 205° position "D" of the pile forming cycle graphically illustrated in FIG. 3.
Figure 9:
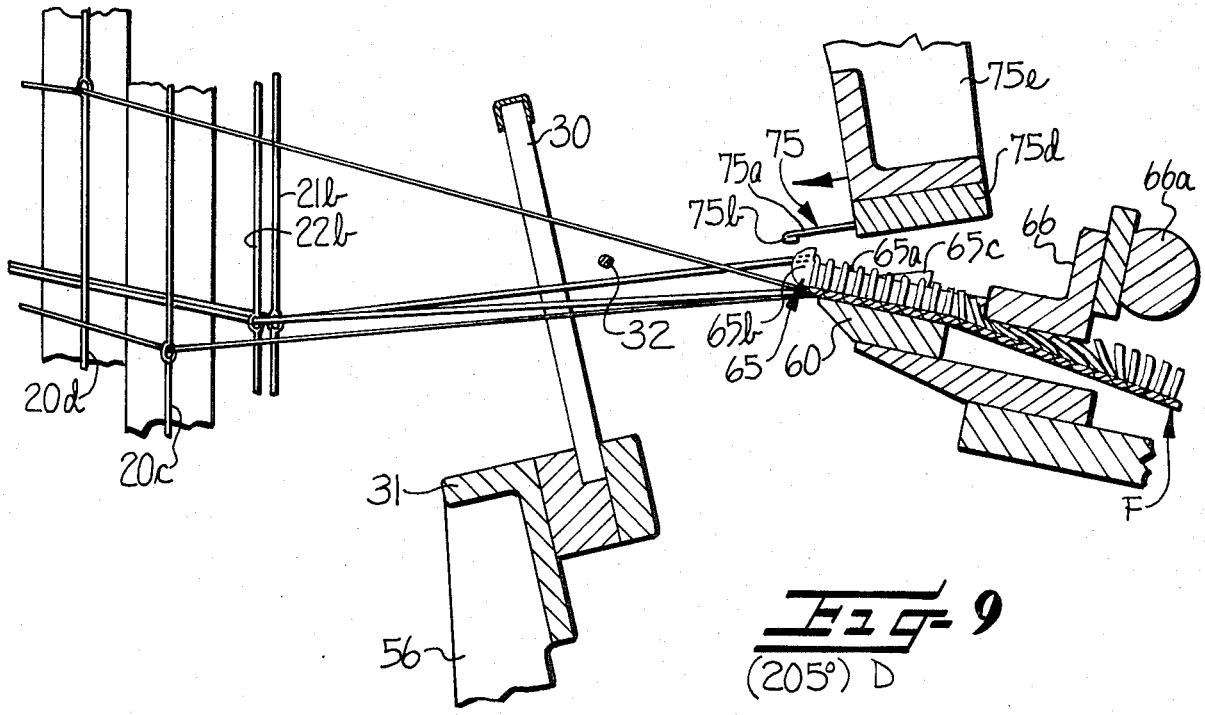
Figure 10:
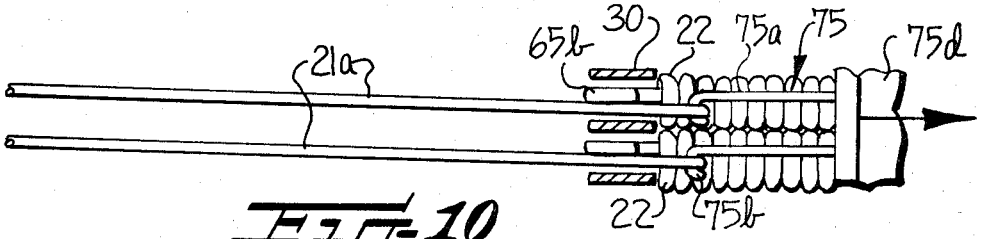
FIGS. 10, 11 and 12 are enlarged fragmentary plan views generally similar to FIGS. 6 and 7 and illustrating additional successive steps in a pile forming cycle of the operation of the pile yarn transfer hooks.
Figure 11:
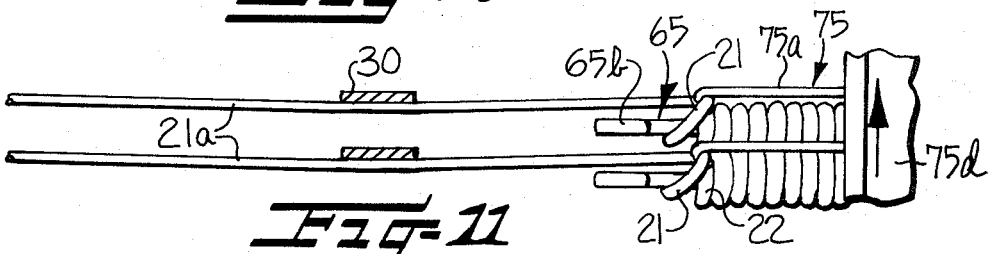

The transfer hooks are then moved forwardly as the reed also is moving forwardly preparatory to beating up the last inserted weft shot 20*c* as the transfer hooks 75 engage and lift the selected pile yarns 21*a* above the bodies 65*a* of the respective pile wires 65. Then the transfer hooks are shogged weftwise in substantially that direction opposite from the direction in which they had last previously been shogged so as to lay the selected pile yarns 21*a* over and across the bodies of the respective pile wires 65 and forwardly of the upstanding portions 65*b* thereof, as indicated in FIGS. 8, 10 and 11. Meanwhile, a shed change again occurs in which all the pile yarns P are lowered to the lower shed position, along with the ground warp yarns 20*a*, and the ground warp yarns 20*b* are moved to the upper open shed position of FIG. 9 preparatory to the insertion and beat up of another weft shot in the shed.

During the latter shed change, the rotary cam 50 causes the transfer hooks 75 to momentarily move rearwardly a relatively short distance, but sufficiently to cause the previously selected pile yarns 21*a* to lodge against the upstanding rear portions 65*b* on the pile wires so as to strip the pile yarns from the hook portions 65*b* of the transfer hooks 75 as the nibs of the hook portions 75*b* move rearwardly beyond the front surfaces of the upstanding portions 65*b* of the pile wires 65 (FIG. 12). Thereupon, the transfer hooks are returned to their previous forward-most position so they are positioned forwardly of the beat up point of the reed 30 and so they will not interfere with the operation of the reed with occurrence of its next succeeding beat-up stroke. It is apparent that the latter beat-up stroke of the reed completes the two shot pile loop forming cycle, with the yarns and the loom parts having thus returned to substantially the positions of FIGS. 1 and 4.

The next succeeding two shot pile loop forming cycle is effected in substantially the same manner as that described in detail above, with the exception that the pile yarns 22*a*, instead of the pile yarns 21*a*, are selected and formed into pile loops 22 over the pile wires 65. Accordingly, a further more detailed description of the manner of forming the pile loops 22 is deemed unnecessary.

It is apparent that, as the woven pile fabric is advanced by the take-up mechanism, not shown, the bights of the pile loops 21, 22 slide along the upper edges of the bodies of the pile wires 65 and thus engage and are thereby cut by the knives 65*c* to produce the cut pile fabric. It is thus seen that the loom will form alternate weftwise extending rows of pile from the pile yarns 21*a* and intervening weftwise rows of pile from the pile yarns 22*a*. Of course, the order of the pile tufts formed of the different pile yarns 21*a*, 22*a* may be varied as desired, since each of the heddles 21*b*, 22*b* may be independently controlled by the jacquard device 37.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. In a loom of the type having a group of elongate warpwise extending pile wires for the formation of pile loops thereover, said pile wires having upstanding rear portions terminating adjacent the fell of the fabric being woven, knives positioned forwardly of said upstanding rear portions of said pile wires for cutting the loops of pile yarns positioned over the pile wires, shed forming means for shedding base warp yarns in forming the backing of the pile fabric and for shedding the pile yarns, pattern means operatively associated with said shed forming means for selecting certain of the pile yarns for forming the desired pile fabric pattern, and a group of transfer hooks for engaging the selected pile yarns and for transferring the same over and across the pile wires for forming pile loops, the combination therewith of means mounting said group of pile wires for unitary pivotal movement about an axis extending weftwise of the loom forwardly of said upstanding rear portions of the pile wires so that the pile wires may be pivotally moved downwardly by the tension in the pile yarns looped thereover for moving the pile wires into engagement with and to rest upon the base fabric being woven to thereby assure obtaining the desired height of pile loops during weaving and to permit the unimpeded movement of the pile loops along the pile wires into engagement with the knives.

2. A loom according to claim 1 including means mounting said group of transfer hooks for reciprocatory forward and rearward movement adjacent said pile wires with the hook portions of the transfer hooks being transversely inclined at an acute angle downwardly from the horizontal, and means for imparting said reciprocatory movement to said group of transfer hooks for effecting engagement of the transfer hooks with the selected pile yarns and for moving the selected pile yarns over and across the pile wires and into engagement with the upstanding rear portions of the pile wires.

3. A loom according to claim 2 wherein said shedding means is operable to move said selected pile yarns from an open upper shed position for forming pile loops over the pile wires, toward an open lower shed position prior to said transfer hooks being disengaged from the selected pile yarns to thereby permit the loom to be operated at a faster speed.

4. In a loom of the type having a group of elongate warpwise extending pile wires for the formation of pile loops thereover, said pile wires having upstanding rear portions terminating adjacent the fell of the fabric being woven, knives forwardly of said upstanding rear portions of sald pile wires for cutting the loops of pile yarns positioned over the pile wires, shed forming means for shedding base warp yarns in forming the backing of the pile fabric and for shedding the pile yarns, pattern means operatively associated with said shed forming means for selecting certain of the pile yarns for forming the desired pile fabric pattern, and a group of transfer hooks for engaging the selected pile yarns and for transferring the same over and across the pile wires for forming pile loops, the combination therewith of means mounting said group of transfer hooks for reciprocatory forward and rearward movement adjacent said pile wires with the hook portions of the transfer hooks being transversely inclined at an acute angle downwardly from the horizontal, means for imparting said reciprocatory movement to said group of transfer hooks for effecting engagement of the transfer hooks with the selected pile yarns and for moving the selected pile yarns over and across the pile wires and into engagement with the upstanding rear portions of the pile wires, and said shedding means being operable to move said selected pile yarns from an open upper shed position for forming pile loops over the pile wires, toward an open lower shed position prior to said transfer hooks being disengaged from the selected pile yarns to thereby permit the loom to be operated at a faster speed.

5. A loom according to claim 1 or 4 wherein said shed forming means for shedding the pile yarns raises all the pile yarns to an open upper shed position with the selected pile yarns under the control of said pattern means positioned at a higher upper shed position than the non-selected pile yarns for facilitating engagement of the transfer hooks therewith.

* * * * *